United States Patent [19]

Chou

[11] Patent Number: 4,978,033

[45] Date of Patent: Dec. 18, 1990

[54] SPRAY CAN DISPENSING DEVICE INCORPORATING GAS POCKET ASSEMBLY

[76] Inventor: Sen H. Chou, No. 109, Lin Kou Rd., Lin Kou Hsiang, Taipei, Hsien, Taiwan

[21] Appl. No.: 358,862

[22] Filed: May 30, 1989

[51] Int. Cl.[5] ..... B67D 5/42; B65D 35/22

[52] U.S. Cl. ..... 222/94; 222/386.5; 222/389

[58] Field of Search ..... 222/94, 386.5, 389, 222/394, 395, 399

[56] References Cited

U.S. PATENT DOCUMENTS

| | | | |
|---|---|---|---|
| 3,245,435 | 4/1966 | Healy | 222/399 |
| 3,430,731 | 3/1969 | Satzinger | 222/389 |
| 3,675,821 | 7/1972 | Morane et al. | 222/389 |
| 3,842,939 | 10/1974 | Satzinger | 222/389 |
| 3,992,003 | 11/1976 | Visceglia et al. | 222/94 |

FOREIGN PATENT DOCUMENTS

| | | | |
|---|---|---|---|
| 3708396 | 10/1987 | Fed. Rep. of Germany | 222/389 |

*Primary Examiner*—Joseph J. Rolla
*Assistant Examiner*—Steve Rein
*Attorney, Agent, or Firm*—Steinberg & Raskin

[57] ABSTRACT

A dispensing device utilizing a gas pocket assembly. The gas pocket assembly includes an inflatable gas pocket and a cylindrical mounting seat. The dispensing device has a gas introduction mechanism for introducing high-pressure gas to the gas pocket assembly, a pressurized cylinder for containing liquid, and a dispensing head mechanism for dispensing the liquid. the gas pocket assembly is secured to a bottom wall of the pressurized cylinder. The dispensing of the liquid, which creates a gradual dropping of pressure, causes the inflatable gas pocket to swell or inflate gradually until the interior of the pressurized cylinder is entirely occupied by the gas pocket.

2 Claims, 4 Drawing Sheets

SPRAY CAN DISPENSING DEVICE INCORPORATING GAS POCKET ASSEMBLY

BACKGROUND OF THE INVENTION

This invention relates to a spray can liquid dispensing device and, more particularly, to a dispensing device which utilizes a high-pressure unit, namely, a gas pocket assembly. According to this invention, the gas pocket assembly is mounted on the dispensing device which comprises a gas introduction means for introducing high-pressure gas, a pressurized cylinder for containing liquid, and a dispensing head means having a tube connected thereto for dispensing the liquid therethrough.

Many kinds of spray can dispensing means have been used for years, but none of them are relevant to the present invention. The gas pocket assembly of this invention comprises an inflatable gas pocket and a cylindrical mounting seat which receives the gas introduction means. The high-pressure gas introduced from the gas introduction means is retained within the inflatable gas pocket.

DETAILED DESCRIPTION OF THE PREFERRED EMBODIMENT

Figure 1:
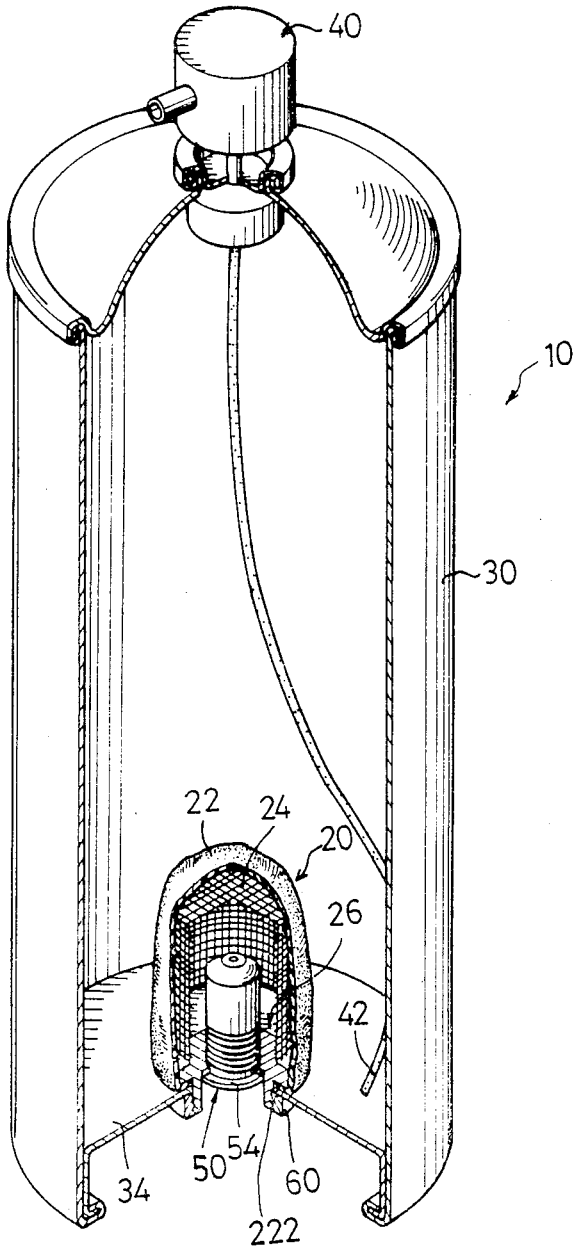
FIG. 1 is a perspective, cutaway view of a spray can dispensing device incorporating a gas pocket assembly in accordance with the present invention.

A spray can dispensing device, designated by reference numeral 10, is shown in FIGS. 1 to 4. The dispensing device 10 has a gas introduction means 50 for introducing high-pressure gas to a gas pocket assembly 20 of the present invention. The dispensing device 10 also has a pressurized cylinder 30 for containing liquid and a dispensing head means 40 which has a tube 42 connected thereto for dispensing the liquid therethrough. The pressurized cylinder 30 has a central bottom hole 32 for mounting the gas pocket assembly 20. The dispensing device 10 comprising the above elements (namely, the gas introduction means 50, the pressurized cylinder 30 and the dispensing head means 40) is conventional and will not be described further here. The present invention relates to the gas pocket assembly 20 which will be further described hereinbelow.

Figure 2:
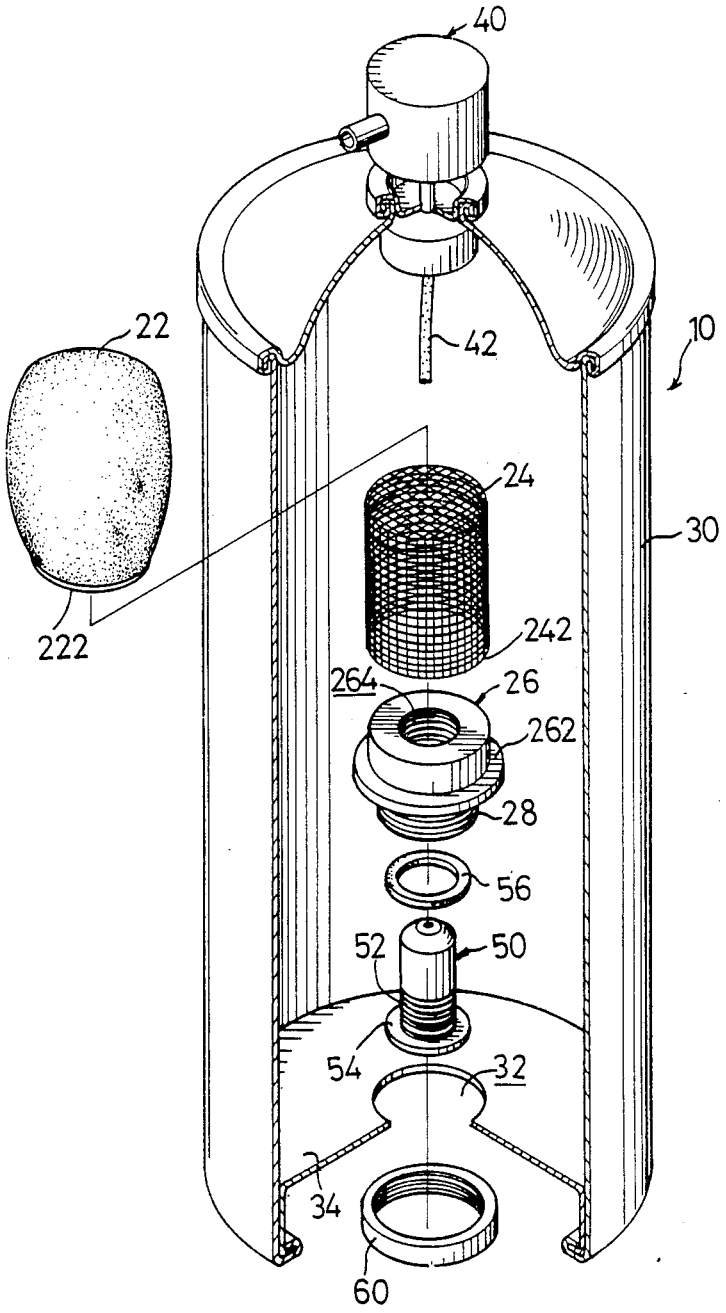
FIG. 2 is an exploded, cutaway view showing the dispensing device incorporating a gas pocket assembly of FIG. 1.

Referring now to FIGS. 1 and 2, the gas pocket assembly 20 comprises the combination of an inflatable gas pocket 22, a cover net 24 and a cylindrical mounting seat The inflatable gas pocket 22 encompasses the cover net 24. The gas pocket 22 has a washer-like rim 222 (best shown in FIGS. 1 and 3) at a bottom edge thereof. The cylindrical mounting seat 26 has a centrally disposed flange 262 and an axial stepped hole 264. The cover net 24 is fixedly mounted on the mounting seat 26 with its open rim 242 contacting upper side of the flange 262. The washer-like rim of the inflatable gas pocket 22 is firmly clamped between the upper end of the bottom wall 54 of the pressurized cylinder 30 and the flange 262 of the mounting seat 26 to form a water-proof and air-tight connection.

Figure 3:
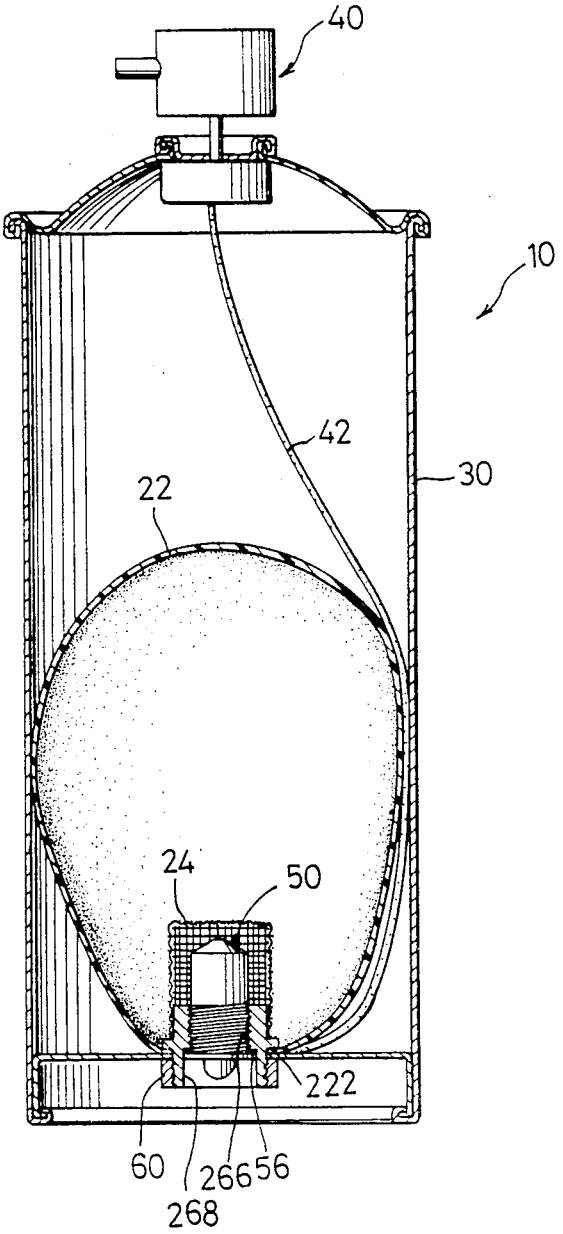
FIG. 3 is a longitudinal cross-sectional view of FIG. 1 with the gas pocket being slightly inflated.

Referring also to FIG. 3, it can be seen that the axial stepped hole 264 consists of a threaded section 266 and a larger section 268, which threadedly receives the has injection means 50. The has injection means 50 is provided with a lower threaded portion 52 and an annular lip 54 thereon. A washer 56 is disposed within the larger section 268 adjacent to the annular lip 54. The mounting seat 26 has an externally threaded portion 28 on a lower end thereof. The threaded portion 28 has a diameter slightly smaller than the central bottom hole 32. The mounting seat 26 is threadedly secured at the central bottom hole 32 of the pressurized cylinder 30 with the washer-like rim 222 of the gas pocket 22 clamped between the flange 262 and the top side of, the bottom wall 34 of the pressurized cylinder 30 by a securing ring 60.

With reference to the above-described embodiment, the dispensing device should be assembled as follows.

The gas pocket assembly 20 is firstly mounted on the bottom wall 34 of the pressurized cylinder 30 which contains liquid. The gas introduction means 50, which is threadedly secured to the mounting seat 26, is then supplied with high-pressure gas. While introducing the high-pressure gas, the inflatable gas pocket 22 tends to swell slightly, but since the liquid outside the gas pocket 22 is incompressible, swelling of the gas pocket 22 is limited to the amount of free or gas-filled space. That is to say, the pressurized cylinder 30 limits the volume of the gas pocket 22.

Figure 4:
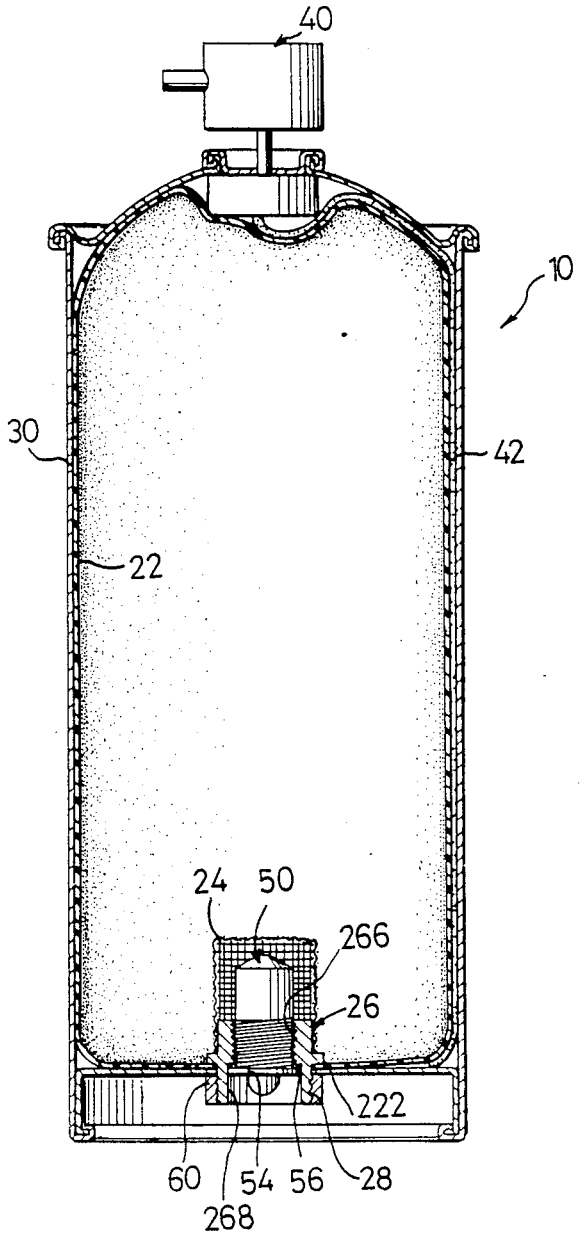
FIG. 4 is a view similar to FIG. 3 except that the gas pocket is fully inflated.

The dispensing head means 40 is utilized for dispensing liquid contained within the pressurized cylinder 30. Though the detailed construction of the dispensing head means 40 will not be further described, it should be pointed out that the dispensing head means 40 utilized here is of a type which converts high-pressure liquid to ambient pressure gas. As shown in FIGS. 3 and 4, the dispensing of the liquid, which creates a gradual dropping of pressure in the cylinder 30, causes the gas pocket 22 to swell or inflate gradually. FIG. 4 shows the interior of the pressurized cylinder 30 entirely occupied by the gas pocket 22. The tube 42 connected to the dispensing head means 40 is preferably apertured so that inflating of the gas pocket 22 does not interfere with the function of the tube 42.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claim.

I claim:

1. A spray can dispensing device (10) having a gas introduction means (50) for introducing high-pressure gas to a gas pocket assembly (20), a pressurized cylinder (30) for containing liquid, and a dispensing head means (40) having a tube (42) connected thereto for dispensing the liquid therethrough; said pressurized cylinder (30) having a central bottom hole (32) for mounting the gas pocket assembly (20), wherein said gas pocket assembly (20) comprises the combination of:

an inflatable gas pocket (22) encompassing a cover net (24), said gas pocket (22) having a washer-like rim (222) at a bottom edge thereof; and a cylindrical mounting seat (26) having a centrally disposed flange (262) and an axial stepped hole (264); said axial stepped hole (264) consisting of a threaded section (266) and a larger section (268) for receiving said gas introduction means (50); said gas introduction means (50) having a lower threaded portion (62) and an annular lip (54) thereon; a washer (66) being disposed within said larger section (268) and adjacent to said annular lip (54); said mounting seat (26) having an externally threaded portion (28) on a lower end thereof; said externally threaded portion (28) having a diameter slightly smaller than said central bottom hole (22); said mounting seat (26) being threadedly secured at the central bottom hole (32) of the pressurized cylinder (30) with said washer-like rim (222) of said gas pocket (22) clamped between said flange (262) and a bottom wall (34) of the pressurized cylinder (30) by a securing ring (60).

2. A dispensing device as claimed in claim 1 characterized in that the tube (42) connected to the dispensing head means (40) has an aperture.

* * * * *